US008440134B2

(12) United States Patent
Rosner et al.

(10) Patent No.: US 8,440,134 B2
(45) Date of Patent: May 14, 2013

(54) FURNACE SYSTEM

(75) Inventors: Johannes Rosner, Linz (AT); Michael Schmid, Bad Rippoldsau-Schapbach (DE)

(73) Assignee: Siemens Aktiengesellschaft, Munich (DE)

( * ) Notice: Subject to any disclaimer, the term of this patent is extended or adjusted under 35 U.S.C. 154(b) by 215 days.

(21) Appl. No.: 12/736,851

(22) PCT Filed: Apr. 3, 2009

(86) PCT No.: PCT/EP2009/053997
§ 371 (c)(1),
(2), (4) Date: Feb. 4, 2011

(87) PCT Pub. No.: WO2009/138297
PCT Pub. Date: Nov. 19, 2009

(65) Prior Publication Data

US 2011/0169202 A1 Jul. 14, 2011

(30) Foreign Application Priority Data

May 16, 2008 (EP) ..... 08009130

(51) Int. Cl.
*C21B 9/10* (2006.01)

(52) U.S. Cl.
USPC ..... 266/135; 432/75

(58) Field of Classification Search ..... 266/135, 266/227, 228; 432/75
See application file for complete search history.

(56) References Cited

U.S. PATENT DOCUMENTS

| | | | | |
|---|---|---|---|---|
| 3,258,256 | A * | 6/1966 | Brooke | 266/96 |
| 3,990,836 | A * | 11/1976 | Bricmont | 432/75 |
| 4,102,001 | A | 7/1978 | Baba et al. | |
| 5,051,180 | A * | 9/1991 | Williams | 210/241 |
| 5,538,226 | A * | 7/1996 | della Foglia | 266/228 |
| 5,827,475 | A * | 10/1998 | Yamashiro et al. | 266/135 |

FOREIGN PATENT DOCUMENTS

| | | |
|---|---|---|
| CN | 1112793 | 11/1995 |
| CN | 2630777 | 8/2004 |
| CN | 2798012 | 7/2006 |
| EP | 08009130 | 5/2008 |
| JP | 59-67308 | 4/1984 |
| WO | 95/04250 | 2/1995 |
| WO | 03/093747 | 11/2003 |
| WO | PCT/EP2009/053997 | 4/2009 |

OTHER PUBLICATIONS

International Search Report for PCT/EP2009/053997, mailed on Jul. 21, 2009.

* cited by examiner

*Primary Examiner* — Scott Kastler
(74) *Attorney, Agent, or Firm* — Staas & Halsey LLP

(57) ABSTRACT

A furnace system has a furnace, particularly an arc furnace, for melting metal, and a cleaning device for removing and/or avoiding bulk goods from or in a furnace opening. The cleaning device has a movable thrust arm for carrying out a thrust movement, and a movement device for moving the thrust arm between a parking level and an operating level. The use of a furnace opening is further made more flexible in that a work platform forming a work level is present, from which the furnace opening is accessible and which carries the cleaning device. The work level has a recess through which the thrust arm can be guided during the movement thereof between the operating level positioning above the work level, and the parking level positioned below the working level.

17 Claims, 3 Drawing Sheets

FURNACE SYSTEM

CROSS REFERENCE TO RELATED APPLICATIONS

This application is based on and hereby claims priority to International Application No. PCT/EP2009/053997 filed on Apr. 3, 2009 and European Application No. 08009130 filed on May 16, 2008, the contents of which are hereby incorporated by reference.

BACKGROUND

The invention relates to a furnace installation for melting metal.

Furnace installations are used, for example, in steelworks for producing steel. In this case, scrap metal and/or reduced iron is supplied to a furnace, for example an arc furnace, in which the metallic solid material is converted into a liquid phase. The molten metal is then conditioned further until a desired quality of the liquid steel is reached.

A furnace for producing molten metal often has a working door. The working door is generally the slag door for taking out the slag before the molten metal is tapped from the furnace. The slag door is also utilized for blowing oxygen onto the liquid metal bath by a lance positioned through the working door, in order to condition the liquid metal.

During the melting process, "buttons" which clog up the working door are formed as a result of steel and slag splashes, and these have to be removed after each melting operation.

The European patent specification EP 0 663 061 A1 discloses a thrust machine, which can be moved on rails, for performing functions in the slag tap hole of steel smelting electric furnaces, equipped with an extendable arm with a front head or shield having a slightly smaller cross section than the slag tap hole of the furnace.

SUMMARY

One possible object is providing a furnace installation of the type mentioned in the introduction, which makes more flexible use of a furnace opening possible.

The inventors propose a furnace installation of the type mentioned in the introduction, wherein a working platform is present, which forms a working level and from which the furnace opening is accessible and which bears the cleaning device, wherein the working level has a cutout, through which the thrust arm can be guided as it moves between the operating level situated above the working level and the parking level situated below the working level. Such a furnace installation makes it possible to flexibly provide free space in front of a furnace opening, which is preferably in the form of a slag door opening.

The working level formed by the working platform is generally formed by the surface of the working platform in the vicinity of the furnace and is generally a plane. The working platform can be designed such that it can be walked on by people, in particular by operating personnel, and therefore in these cases the working level can also be walked on.

The thrust arm on the parking level is preferably not arranged above the working level.

Since the cleaning device is arranged so as to be retractable on the working platform, it is possible to make more flexible use of the furnace opening, in particular a slag door opening. This is because once the furnace opening has been freed from bulk material, in particular metallic deposits, by the cleaning device and/or deposition of bulk material in the furnace opening has been avoided by the cleaning device, it is possible—after the thrust arm of the cleaning device has moved to the parking level—for a manipulator, for example, to be used on the furnace opening, for instance for measuring the temperature of the metal bath, for taking samples or for blowing oxygen onto the metal bath, etc.

As a result of the proposal, more free space, which can be provided more quickly, is therefore available on the working platform for the operating personnel or interventions in the process on the furnace through the furnace opening. The cleaning device can be provided quickly and flexibly if required—i.e. if the furnace opening is becoming increasingly clogged up. The saving of space additionally leads to increased operational safety in that region of the working platform close to the furnace. In particular, during the operation for charging the furnace with charging material, the furnace opening can also be kept free from charging material by the cleaning device, in particular the thrust arm. For this case, the thrust arm is retracted into the furnace opening before the charging material is charged into the furnace, as a result of which the deposition of scrap is avoided during the charging in the region of the furnace opening.

On the operating level, the thrust arm is moved in the longitudinal direction thereof. As a result of the possibly repeated movement of the thrust arm in the longitudinal direction, the bulk material is removed from the region of the furnace opening and the furnace opening, in particular the slag door opening, can be used, for example, for the detection of parameters of the metal bath and/or of the furnace and, if appropriate, for the manipulation thereof.

On the parking level, the cleaning device is advantageously arranged in the most compact manner possible. By way of example, the thrust arm has been retracted so that the least possible space is taken up. In the parking level, the cleaning device is preferably shielded to the greatest possible extent from the thermal influences emanating from the furnace by the refractory lining of the recess of the working platform.

The cutout on the working level, which is passed through when the thrust arm moves between the parking level and the operating level, may have any desired form. It is preferable for the cutout to have a rectangular form. However, it is important that the thrust arm can move without hindrance and without damage from the parking level to the operating level and from the operating level to the parking level. The working platform likewise has a recess which corresponds to the cutout and in which the cleaning device is recessed fully when the thrust arm is arranged on the parking level. Within the context of this application, the cutout therefore has a two-dimensional, i.e. planar, extent, whereas the corresponding recess in the working platform has a three-dimensional, i.e. spatial, extent.

The movement device for moving the thrust arm between a parking level and an operating level can be realized in mechanical, hydraulic, pneumatic or electrical form or in another form. By way of example, lifting shears can be provided.

In one advantageous refinement, the cutout can be covered with a closing element when the thrust arm is arranged on the parking level. This is possible particularly when the cleaning device is not completely arranged above the working level when the thrust arm is arranged on the parking level. The closing element can be formed as part of the cleaning device, for example by a housing of the thrust arm, or as a separate component which may be independent of the cleaning device. The closing element can be operated manually and/or automatically, for example. A closing element of this type further increases the safety on the working platform, since the cutout can be closed if the cleaning device is not required. The closing or covering of the cutout on the working level means that additional space is usable on the working platform, since the working platform can be utilized fully, for example, by the operating personnel or movable robots. The closing element preferably has stiffening ribs. This firstly increases the safety on the working platform and also makes improved operation of the furnace possible.

In a further advantageous refinement, the working platform and/or the closing element are refractory. The cleaning device is thereby protected from excessively high heat on the parking level, as a result of which the service life of the cleaning device is increased.

In a further advantageous embodiment, the closing element can be moved automatically so as to open the cutout before or during the movement of the thrust arm from the parking level to the operating level. This can be achieved particularly easily, for example, by arranging the closing element on the cleaning device or connecting it thereto. However, the closing element may also be part of the working platform, for example. In any case, the operating personnel therefore do not have to take any additional measures—for example manual opening of the closing element—in order to move the thrust arm of the cleaning device to the operating level, as a result of which the safety for the operating personnel is increased. Furthermore, the thrust arm is thereby prevented from colliding with the closing element, as a result of which the service life of the cleaning device is increased.

In a further advantageous embodiment variant, the closing element can be moved automatically so as to close the cutout during or after the movement of the thrust arm from the operating level to the parking level. This has the effect that the cutout is covered in good time after the cleaning device has moved to the parking level. The safety on the working platform is thereby increased for the operating personnel. Operating personnel do not have to manually ensure that the cutout is covered, nor are they exposed to the adverse temperature conditions during such an operation close to the furnace.

In a further advantageous refinement, a charging device for conveying charging material can be guided by a guide device to the furnace opening when the thrust arm is arranged on the parking level. The use of the furnace opening and therefore also the operation of the furnace or of the entire furnace installation are thereby made more flexible and improved. It is then possible for pig iron to be charged in the case of a "countersunk" cleaning device. Chutes, conveyor belts, charging containers or else charging robots and other charging devices can be used as the charging device. By way of example, guide rails, guide grooves or other suitable guide devices are used as the guide devices.

In a further advantageous embodiment, the working platform has at least two guide rails for guiding a charging device to the working door, the cutout being arranged between two, in particular a pair of, guide rails. Such an embodiment is advantageous for particularly heavy charging devices, since here the forces of the weight of the charging device and of the charging material held thereby can be deflected directly into the working platform, in particular in a well-distributed manner. A deflection of forces is possible, in particular, using a multiplicity of approximately parallel guide rails. The cleaning device having a thrust arm arranged on the parking level is thereby not subjected to high forces. This increases the service life of the cleaning device.

In a further advantageous refinement, supply lines for the cleaning device are arranged at least in certain portions underneath the working level. The supply lines are preferably arranged at least in certain portions within the working platform. As a result, the supply lines, for example for electricity and media, for instance gas for pneumatic cylinders or liquid for hydraulic cylinders, are well protected against the thermal influences during the production of molten metal at least in those regions in which they are arranged underneath the working level, preferably within the working platform.

In a further advantageous embodiment, the movement device for moving the thrust arm comprise at least one rotatable guide element, which is arranged on the working platform and guides the thrust arm, and also a lifting device for lifting and lowering the thrust arm. Such a design of the movement device for moving the thrust arm makes it possible to provide a particularly simple, inexpensive and safe way to move the thrust arm of the cleaning device. The lifting device preferably acts directly on the thrust arm or on a housing of the thrust arm, and the at least one guide element moves the thrust arm on a path curve, which is in the form of a portion of a circular ring, between the parking level and the operating level. This can have the effect that the retractable and extendable thrust arm passes particularly close to and/or particularly deep with respect to a furnace opening. The efficiency of the cleaning is thereby improved.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
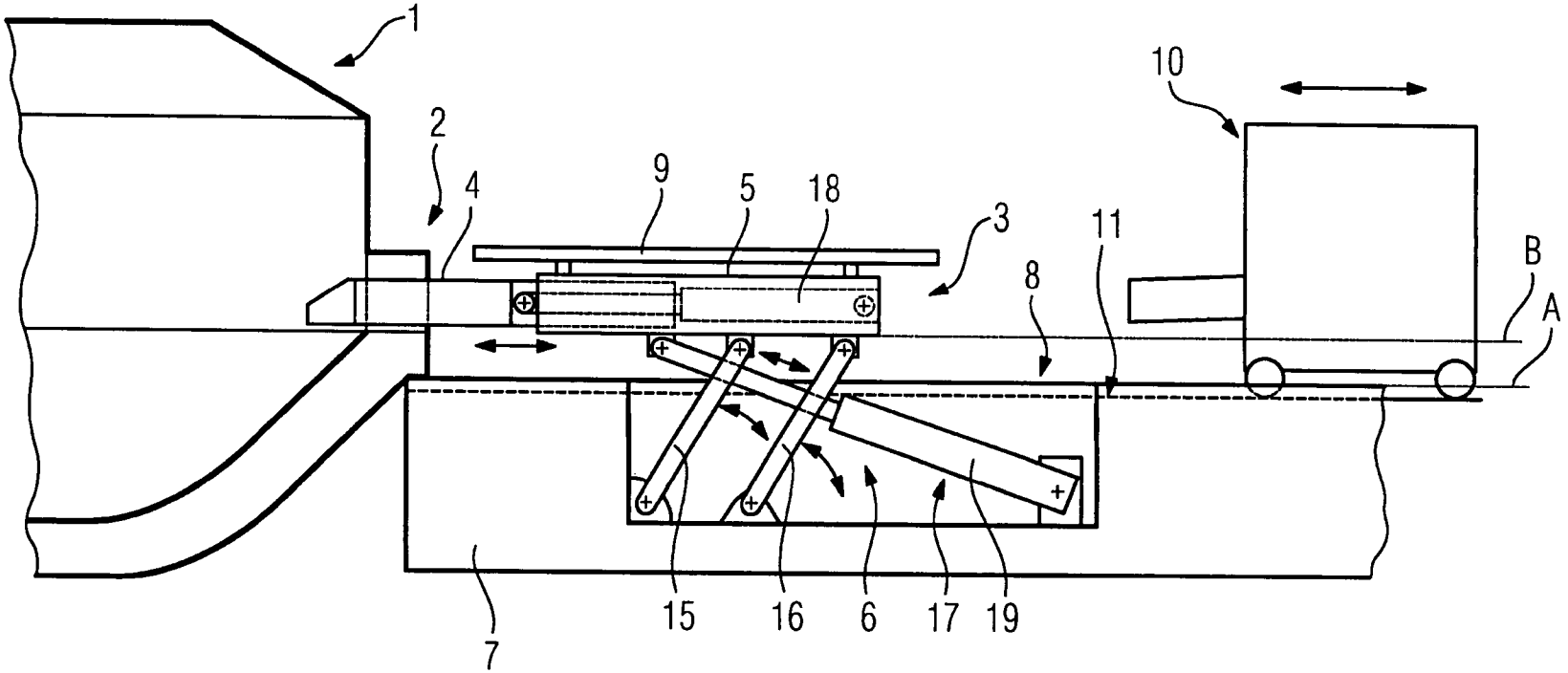
FIG. 1 is a side view showing a furnace installation comprising a working platform, a charging device in the parking position and a cleaning device with a thrust arm on the operating level.

Reference will now be made in detail to the preferred embodiments of the present invention, examples of which are illustrated in the accompanying drawings, wherein like reference numerals refer to like elements throughout.

FIG. 1 shows a furnace installation comprising a furnace 1, which is in the form of an electric arc furnace, for producing molten metal from solid metal. The furnace 1 has a plurality of furnace openings, for instance an opening for the introduction of electrodes in order to form an arc, an opening for removing dust/gas from the furnace, a tapping opening and a slag door opening.

In the text which follows, the slag door opening is regarded as being the furnace opening 2. During operation of the arc furnace 1, metallic, solidifying deposits are formed at the slag door opening 2, and these can hinder the access of the molten material through the slag door. Deposits of this type are covered, inter alia, by the term "bulk material". The bulk material is not shown in FIG. 1.

A cleaning device 3 is present for the removal of the bulk material. The device has a thrust arm 4 arranged in a housing 5. The thrust arm 4 is movable, preferably horizontally, in the longitudinal direction thereof. The thrust arm 4 has a resistant head, by which the bulk material can be removed with a low degree of wear. In the exemplary embodiment, the thrust arm 4 is moved in the longitudinal direction thereof by hydraulic cylinders 18. However, it is also possible to provide an alternative movement device for moving the thrust arm 4 in the longitudinal direction, for example pneumatic cylinders, adjustment by motor, etc.

The cleaning device 3 also comprises a movement device 6 for moving the thrust arm 4, preferably at least in certain portions in the vertical direction. These movement device 6 can be used to move the thrust arm 4 between a parking level P, cf. FIG. 2, and an operating level B. The parking level P, cf. FIG. 2, and the operating level B are generally different height levels. On the parking level P, cf. FIG. 2, the thrust arm 4 is located underneath the operating level B, whereas it is located above the parking level P on the operating level B.

In the present exemplary embodiment, the movement device 6 for moving the thrust arm comprise a first guide element 15 and a second guide element 16 and also a lifting device 17. The thrust arm 4 can thereby be lifted together with the housing 5 from the parking level P to the operating level B and lowered from the operating level B to the parking level P, cf. FIG. 2. In the process, it is generally the case that all intermediate levels between the parking level P and the operating level B are passed through. The lifting device 17 is preferably operated hydraulically and therefore has a hydraulic cylinder 19. The lifting device 17 is configured such that the force for lifting and lowering the thrust arm 4 is transferred directly onto the thrust arm 4 or the housing 5 thereof. The guide elements 15 and 16 are configured such that the thrust arm 4 moves on a path curve which is in the form of a portion of a circle when it moves between the parking level P, cf. FIG. 2, and the operating level B. This is a particularly simple and advantageous design of the movement device 6 for moving the thrust arm 4.

The furnace installation 1 comprises a working platform 7 which, by virtue of its walkable surface, forms a working level A. The working level A is located between the parking level P, cf. FIG. 2, and the operating level B. If the thrust arm 4 is on the parking level P, cf. FIG. 2, it is arranged not above but preferably underneath the working level A in the exemplary embodiment. In particular, in this state it is preferable that no part of the cleaning device 3 protrudes beyond the working level A.

The cleaning device 3 is mounted on the working platform 7. In particular, the working platform 7 has a recess, within which the movement device 6 for moving the thrust arm 4 are arranged. A cutout 8 corresponds to the recess on the working level A. The thrust arm 4 moves through the cutout 8 on the working level A as it moves between the parking level P and the operating level B.

A closing element 9 is furthermore arranged on the housing 5 of the cleaning device 3. In the present exemplary embodiment, the closing element 9 is connected rigidly to the housing 5 of the thrust arm 4. By way of example, the closing element 9 can also be realized by a part of the housing 5. If the thrust arm 4 is moved between the parking level P, cf. FIG. 2, and the operating level B, the closing element 9 is moved along therewith. The closing element 9 is dimensioned such that the cutout 8 can preferably be covered substantially completely. The closing element 9 is therefore designed such that it moves automatically so as to close the cutout 8 during movement of the thrust arm 4 from the operating level B to the parking level P, cf. FIG. 2, whereas the closing element 9 is moved so as to open the cutout 8 during movement of the thrust arm 4 from the parking level P, cf. FIG. 2, to the operating level B. In such an embodiment, it is possible to dispense with additional ways for automatically covering and uncovering the cutout 8. The embodiment of the closing element 9 shown here is technically particularly simple and is not very susceptible to faults.

The closing element 9 is refractory, i.e. for example is lined with refractory material. This provides good thermal insulation of the cleaning device 3.

Figure 2:
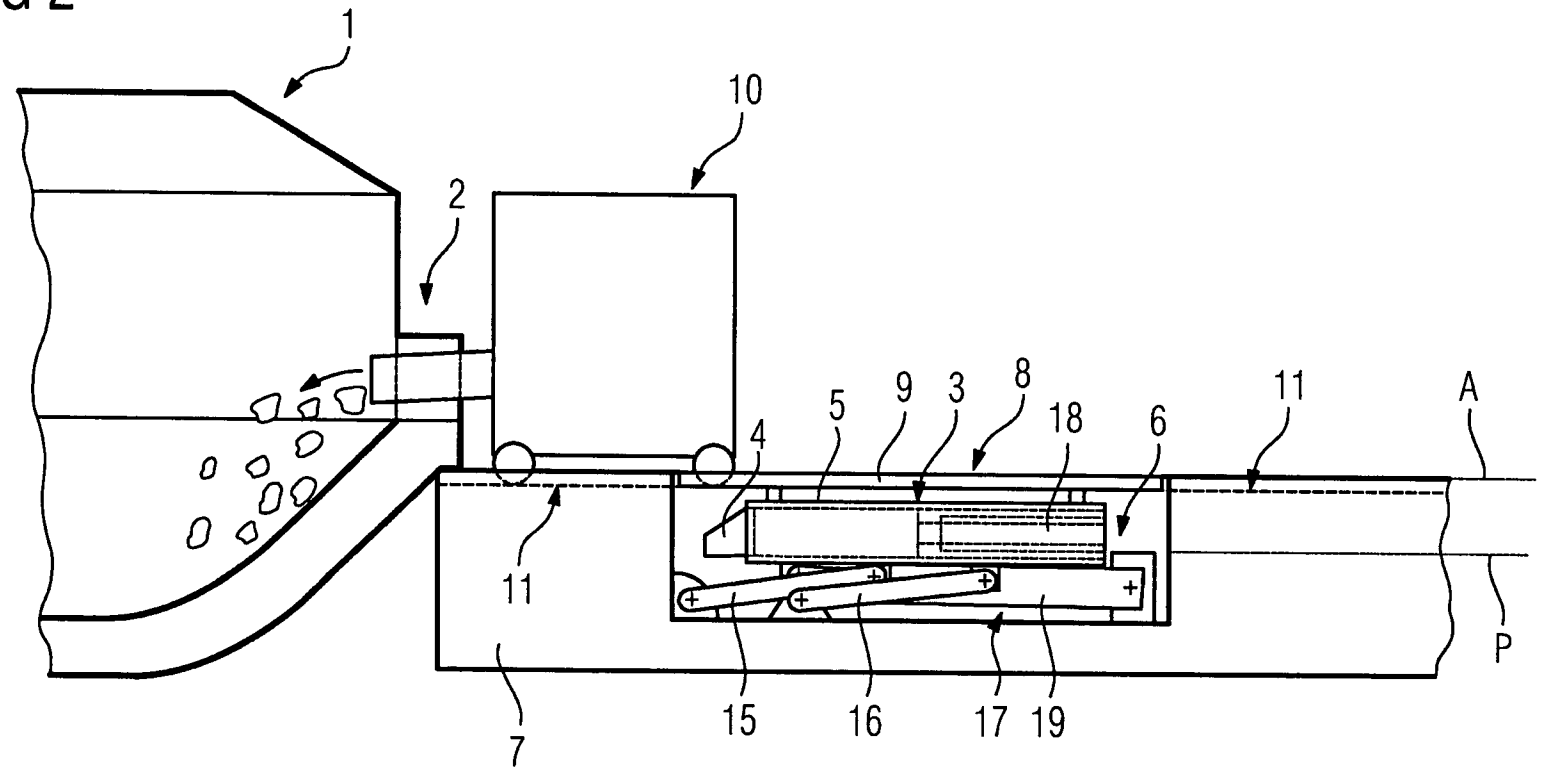
FIG. 2 is a side view showing a furnace installation comprising a working platform, a charging device in the charging position and a cleaning device with a thrust arm on the parking level.

FIG. 2 shows the cleaning device 3 from FIG. 1, the thrust arm 4 of the cleaning device 3 being arranged on the parking level P. The closing element 9 arranged on the housing 5 of the thrust arm 4 covers the cutout 8 substantially completely, i.e. except for gaps which pose a negligible threat between the working platform 7 and the closing element 9, or preferably completely.

Since the top side of the closing element 9, in the covering state, terminates substantially flush with the working level A formed by the surface of the working platform 7, it is possible to guide a charging device 10 up to the slag door 2, in order to thereby charge charging material, preferably pig iron, into the furnace 1 through the slag door 2 which has been freed from bulk material.

In order to ensure that the charging device 10 is guided up to the slag door 2 in a targeted manner, the charging device can be moved, preferably automatically, with the aid of a guide device 11. The charging device 10 can be moved, preferably by remote control, up to and away from the slag door 2 by the guide device 11. For this purpose, the charging device 10 has an appropriately operable drive device (not shown).

Since the thrust arm 4 of the cleaning device 3 can be moved between the parking level P and the operating level B, cf. FIG. 1, it is therefore possible to provide operating space for a charging robot or a manipulator, for example, quickly and flexibly. Automated movement of the thrust arm 4 between the parking level P and the operating level B, cf. FIG. 1, additionally releases human resources, as a result of which start-up times for measurements by manipulators, charging and cleaning of the slag door can be reduced by carrying out operating sequences in parallel.

Figure 3:
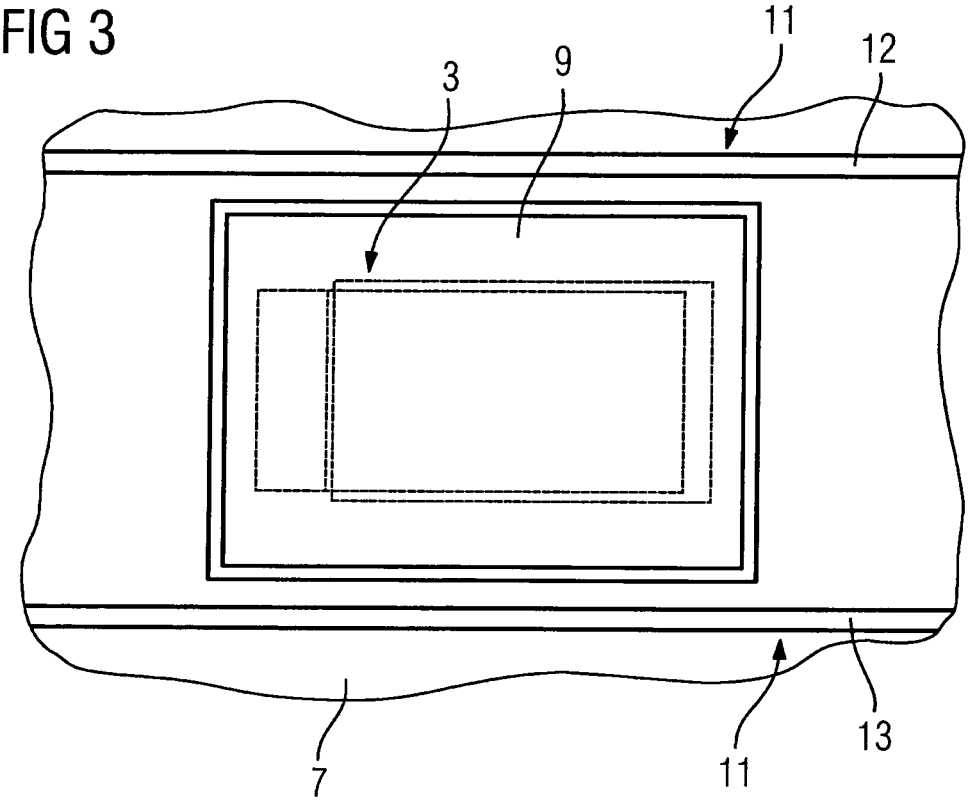
FIG. 3 is a plan view showing a cutout which is arranged between two guide rails and is covered by a closing element.

FIG. 3 is a plan view showing a section of the working platform 7 from FIG. 1 and FIG. 2 with a guide device 11. The closing element 9 or the cleaning device 3 is arranged between a first guide rail 12 and a second guide rail 13. In the present exemplary embodiment, the guide rails 12 and 13 are encompassed by the guide device 11 and serve to guide apparatuses to be conducted to the slag door, for example a charging device. Such an arrangement of the cleaning device 3 in relation to the two guide rails 11 and 12 prevents the force of the weight of the apparatus to be guided to the slag door from being introduced into the cleaning device 3. The force of the weight is absorbed by the working platform 7, which is also designed for such loadings. Such an arrangement of the cleaning device 3 or of the cutout in relation to a pair of guide rails 12 and 13 makes it possible to avoid mechanical load peaks on the cleaning device 3, as a result of which the cleaning device 3 can be implemented at lower cost but nevertheless with a long service life.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV*, 69 USPQ2d 1865 (Fed. Cir. 2004).

The invention claimed is:

1. A furnace system comprising:

a furnace for melting metal, the furnace having a furnace opening;

a cleaning device to remove bulk material from the furnace opening and/or to avoid the deposition of bulk material in the furnace opening, the cleaning device comprising:

a movable thrust arm for performing a thrust movement and means for moving the thrust arm between a parking level and an operating level, and a working platform, which defines a working level and from which the furnace opening is accessible, the working platform bearing the cleaning device, wherein the working level has a cutout, through which the thrust arm moves between the operating level situated above the working level and the parking level situated below the working level.

2. The furnace system as claimed in claim 1, further comprising a closing element to cover the cutout when the thrust arm is arranged on the parking level.

3. The furnace system as claimed in claim 1, wherein the working platform is refractory.

4. The furnace system as claimed in claim 2, wherein the closing element is moved automatically so as to open the cutout before or during the movement of the thrust arm from the parking level to the operating level.

5. The furnace system as claimed in claim 2, wherein the closing element is moved automatically so as to close the cutout during or after the movement of the thrust arm from the operating level to the parking level.

6. The furnace system as claimed in claim 1, further comprising:

a charging device for conveying charging material; and a guide device to guide the charging device into the furnace opening when the thrust arm is arranged on the parking level.

7. The furnace system as claimed in claim 1, further comprising:

at least two guide rails provided on the working platform to guide a charging device to the furnace opening, the cutout being arranged between a pair of the at least two guide rails.

8. The furnace system as claimed in claim 1, further comprising:

supply lines connected to the cleaning device from a location underneath the working level.

9. The furnace system as claimed in claim 1, wherein the movement device comprises:

at least one rotatable guide element, which is arranged on the working platform and guides the thrust arm; and a lifting device for lifting and lowering the thrust arm.

10. The furnace system as claimed in claim 2, wherein the furnace is an arc furnace.

11. The furnace system as claimed in claim 10, wherein the working platform and the closing element are refractory.

12. The furnace system as claimed in claim 11, wherein the closing element is moved automatically so as to open the cutout before or during the movement of the thrust arm from the parking level to the operating level.

13. The furnace system as claimed in claim 12, wherein the closing element is moved automatically so as to close the cutout during or after the movement of the thrust arm from the operating level to the parking level.

14. The furnace system as claimed in claim 13, further comprising:

a charging device for conveying charging material; and a guide device to guide the charging device into the furnace opening when the thrust arm is arranged on the parking level.

15. The furnace system as claimed in claim 14, further comprising:

at least two guide rails provided on the working platform to guide the charging device to the furnace opening, the cutout being arranged between a pair of the at least two guide rails.

16. The furnace system as claimed in claim 15, further comprising:

supply lines connected to the cleaning device from a location underneath the working level.

17. The furnace system as claimed in claim 16, wherein the means for moving comprises:

a rotating device having a first end mounted on the working platform and within the recess, and a second end connected to the thrust arm; and a lifting cylinder having a first end mounted on the working platform and within the recess, and a second end connected to the thrust arm such that when the lifting cylinder is expanded, the rotating device rotates and lifts the thrust arm from the parking level to the operating level.

* * * * *